US006764798B2

(12) United States Patent
Yamazaki et al.

(10) Patent No.: US 6,764,798 B2
(45) Date of Patent: Jul. 20, 2004

(54) TWO-COMPONENT DEVELOPER

(75) Inventors: Masahito Yamazaki, Wakayama (JP); Koji Kameyama, Wakayama (JP); Koji Akiyama, Wakayama (JP)

(73) Assignee: Kao Corporation, Tokyo (JP)

( * ) Notice: Subject to any disclaimer, the term of this patent is extended or adjusted under 35 U.S.C. 154(b) by 6 days.

(21) Appl. No.: 10/255,630

(22) Filed: Sep. 27, 2002

(65) Prior Publication Data

US 2003/0129515 A1 Jul. 10, 2003

(30) Foreign Application Priority Data

Sep. 27, 2001 (JP) ..... 2001-297894

(51) Int. Cl.[7] ..... G03G 9/08; G03G 9/10; G03G 13/09

(52) U.S. Cl. ..... 430/108.7; 430/110.4; 430/111.41; 430/122

(58) Field of Search ..... 430/108.7, 111.41, 430/110.4, 120, 122

(56) References Cited

U.S. PATENT DOCUMENTS 6,214,507 B1 * 4/2001 Sokol et al. ..... 430/108.2
6,294,304 B1 * 9/2001 Sukovich et al. ..... 430/111.31

FOREIGN PATENT DOCUMENTS

JP 62-042163 * 2/1987
JP 04-66958 * 3/1992

OTHER PUBLICATIONS

Patent Abstracts of Japan English–Language Abstract Describing JP 62–042163, Copyright 1998, 2003.*
Patent Abstracts of Japan English–Language Abstract Describing JP 04–66958, Copyright 1998, 2003.*
*Micro–Patent* English Abstract Describing JP–6–332253, 2002.

* cited by examiner

*Primary Examiner*—Janis L. Dote
(74) *Attorney, Agent, or Firm*—Birch Stewart Kolasch & Birch

(57) ABSTRACT

A two-component developer comprising a toner onto which a hydrophobic silica having an average particle size of 25 nm or more is externally added, and a carrier having a saturation magnetization of from 50 to 95 $Am^2/kg$, wherein the carrier has a ratio of surface resistivity to volume resistivity of from $1\times10^2$ to $1\times10^4$ $m^{-1}$ at an electric field strength of 100 V/cm; and a method for development comprising applying the above two-component developer to an electrophotographic device comprising a photoconductor having a peripheral speed of 400 mm/sec or more, and developing a latent image. The two-component developer can be used for the development of a latent image formed in electrophotography, electrostatic recording method, electrostatic printing method or the like.

5 Claims, 1 Drawing Sheet

TWO-COMPONENT DEVELOPER

BACKGROUND OF THE INVENTION

1. Field of the Invention

The present invention relates to a two-component developer used for the development of a latent image formed in electrophotography, electrostatic recording method, electrostatic printing method or the like.

2. Discussion of the Related Art

During durablity printing in a high-speed machine or durability printing in a low toner-consumptive mode, such as a long-term printing of fixed images in a low printing ratio, fixed images are likely to be deteriorated due to a decrease in image density and the like with the embedment of silica. Therefore, there has been proposed to use a toner in which an external additive having a large particle size is used (Japanese Patent Laid-Open No. Hei 6-332253), or to use a carrier having a low saturation magnetization. However, the decrease in image density, the background fogging, the toner scattering, the carrier sticking on photoconductor and the like may be caused.

An object of the present invention is to provide a two-component developer which can continuously give high-quality images, even in a high-speed machine, without causing the embedment of silica and the carrier sticking on photoconductor.

SUMMARY OF THE INVENTION

The present invention relates to a two-component developer comprising:

a toner onto which a hydrophobic silica having an average particle size of 25 nm or more is externally added, and a carrier having a saturation magnetization of from 50 to 95 $Am^2/kg$, wherein the carrier has a ratio of surface resistivity to volume resistivity of from $1\times10^2$ to $1\times10^4$ $m^{-1}$ at an electric field strength of 100 V/cm.

DETAILED DESCRIPTION OF THE INVENTION

Figure 1:
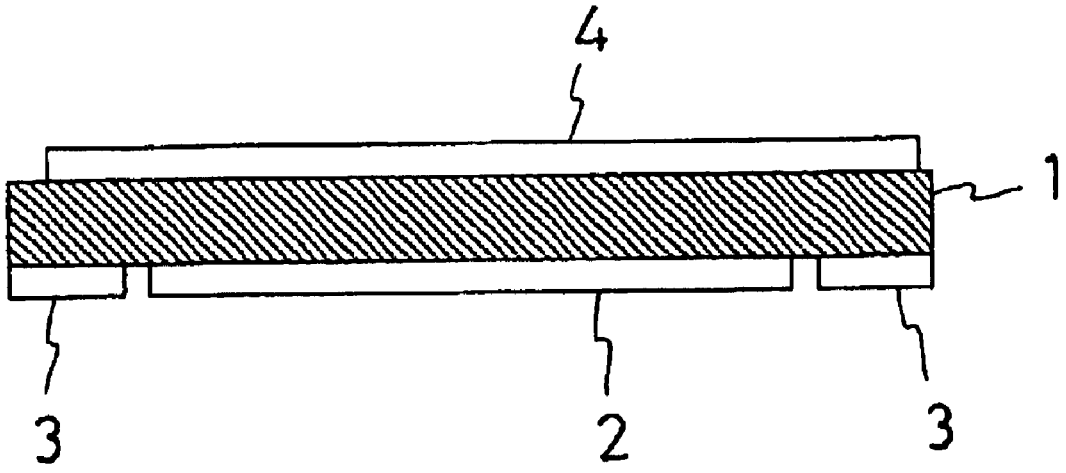
FIG. 1 is a cross-sectional view of a device used for the determination of the surface resistivity and the volume resistivity of the carrier.

One of the greatest features of the present invention resides in that the ratio of the surface resistivity (Rs) to the volume resistivity (Rv) of a carrier is adjusted. The embedment of silica can be suppressed by increasing the particle size of a silica and lowering the saturation magnetization of a carrier. However, when the saturation magnetization of a carrier is low, the formation of the magnetic brush is insufficient, so that the carrier sticking on a photoconductor is likely to be caused.

In the present invention, it has been found that the embedment of silica can be prevented and the carrier sticking on photoconductor can be suppressed by adjusting the ratio of surface resistivity to volume resistivity (Rs/Rv) of a carrier, so that high-quality images can be continuously obtained. When the Rs/Rv is outside a specified ratio range, a problem of low-image density is likely to arise in the high-Rv region, and the carrier sticking on photoconductor and the background fogging are likely to be caused in the low-Rv region. From these viewpoints, the ratio of surface resistivity to volume resistivity (surface resistivity/volume resistivity) is from $1\times10^2$ to $1\times10^4$ $m^{-1}$, preferably from $2.5\times10^2$ to $5\times10^3$ $m^{-1}$, more preferably from $5\times10^2$ to $5\times10^3$ $m^{-1}$ at an electric field strength of 100 V/cm. Here, the surface resistivity and the volume resistivity can be determined by the method described in "TR87-1 Denki Anzen Shishin (Guideline for Electrical Safety)" (published by the head office of Industrial Safety Association, the Ministry of Labor, 1988).

Rs is preferably from $1\times10^{10}$ to $1\times10^{17}$ Ω, more preferably from $5\times10^{11}$ to $1\times10^{16}$ Ω, especially preferably from $1\times10^{14}$ to $5\times10^{15}$ Ω. Also, Rv is preferably from $1\times10^8$ to $1\times10^{16}$ Ωm, more preferably from $1\times10^{10}$ to $1\times10^{14}$ Ωm, especially preferably from $1\times10^{11}$ to $5\times10^{13}$ Ωm.

The carrier has a saturation magnetization of from 50 to 95 $Am^2/kg$ (emu/g), preferably from 50 to 85 $Am^2/kg$, more preferably from 55 to 70 $Am^2/kg$, in order to suppress the impact on the silica by the magnetic brush, thereby preventing the embedment of the silica.

In the present invention, the carrier comprises a core material and, if necessary, a coating agent. The core material includes magnetite, zinc-based ferrite, nickel-based ferrite, copper-based ferrite, copper-zinc-based ferrite, nickel-zinc-based ferrite, manganese-based ferrite, magnesium-based ferrite, manganese-magnesium-based ferrite, manganese-magnesium-strontium-based ferrite, copper-magnesium-based ferrite, manganese-zinc-based ferrite, manganese-copper-zinc-based ferrite, and the like. Among them, manganese-based ferrite, magnesium-based ferrite, manganese-magnesium-based ferrite, and manganese-magnesium-strontium-based ferrite, each not containing a heavy metal are preferable, from the viewpoints of the environmental pollutions.

The surface of the core material may be coated with a known coating agent such as a fluororesin, a silicone resin, an acrylic resin, a polyester resin, a polyolefin resin, a polyvinyl resin, a polyvinylidene resin, a phenolic resin, an amino resin, an epoxy resin or a urethane resin. Among them, the silicone resin is preferable from the viewpoints of the triboelectric chargeability and the resistance adjustment.

The core material can be coated with the resin by, for instance, dissolving the resin in an organic solvent or the like, applying the resulting solution to a carrier surface by immersion, spraying or the like, thereafter drying, thermally curing or the like, to form a coating film.

The carrier has a weight-average particle size of preferably from 30 to 80 μm, more preferably from 50 to 75 μm, in order to suppress the impact on the toner, thereby preventing the embedment of the silica.

In addition, the content of the carrier particles having a particle size of 22 μm or less is preferably 2% by weight or less, more preferably 1.5% by weight or less, especially preferably 0.5% by weight or less, from the viewpoint of the fluidity of the carrier.

In the present invention, any toner comprising a resin binder, a colorant and the like can be used without particular limitation, as long as a specified hydrophobic silica is externally added thereonto.

The method of hydrophobic treatment of the silica is not particularly limited. The agent for hydrophobic treatment includes hexamethyldisilazane, dimethyldichlorosilane, silicone oil, methyltriethoxysilane, and the like. Among them, hexamethyldisilazane is preferable. It is preferable that the amount of the agent for hydrophobic treatment is from 1 to 7 $mg/m^2$ per surface area of the fine inorganic particles.

The hydrophobic silica has an average particle size of 25 nm or more, preferably from 25 to 1000 nm, more preferably from 30 to 100 nm, in order to prevent the embedment of the silica into the inner portion of the toner.

The amount of the hydrophobic silica having an average particle size of 25 nm or more which is externally added is preferably from 0.01 to 10 parts by weight, more preferably from 0.1 to 5 parts by weight, especially preferably from 0.5 to 3 parts by weight, based on 100 parts by weight of the untreated toner.

Incidentally, in the present invention, a hydrophobic silica having an average particle size of less than 25 nm, preferably from 5 to 20 nm, more preferably from 10 to 20 nm, may also be externally added together therewith.

The weight ratio of the hydrophobic silica having an average particle size of 25 nm or more to the hydrophobic having an average particle size of less than 25 nm (hydrophobic silica of 25 nm or more/hydrophobic silica of less than 25 nm) is preferably from 5/95 to 95/5, more preferably from 20/80 to 80/20.

The resin binder for the toner includes polyesters, styrene-acrylic resins, epoxy resins, polycarbonates, polyurethanes, and the like. Among them, the polyesters are preferable. The content of the polyester is preferably from 50 to 100% by weight, more preferably from 90 to 100% by weight, especially preferably 100% by weight, of the resin binder.

The raw material monomers for the polyester in the present invention are not particularly limited, and known alcohol components and known carboxylic acid components such as carboxylic acids, carboxylic acid anhydrides, and esters of carboxylic acids are used.

The alcohol component includes alkylene(2 to 3 carbon atoms) oxide(average number of moles: 1 to 16) adduct of bisphenol A such as polyoxypropylene(2.2)-2,2-bis(4-hydroxyphenyl)propane and polyoxyethylene(2.2)-2,2-bis(4-hydroxyphenyl)propane, ethylene glycol, propylene glycol, glycerol, pentaerythritol, trimethylolpropane, hydrogenated bisphenol A, sorbitol, or alkylene(2 to 4 carbon atoms) oxide(average number of moles: 1 to 16) adducts thereof, and the like. These can be used alone or in admixture of two or more kinds.

In addition, the carboxylic acid component includes dicarboxylic acids such as phthalic acid, isophthalic acid, terephthalic acid, fumaric acid, and maleic acid; a substituted succinic acid of which substituent is an alkyl group having 1 to 20 carbon atoms or an alkenyl group having 2 to 20 carbon atoms, such as dodecenylsuccinic acid and octylsuccinic acid; 1,2,4-benzenetricarboxylic acid (trimellitic acid) and pyromellitic acid; acid anhydrides thereof; alkyl(1 to 8 carbon atoms) esters thereof; and the like. These can be used alone or in admixture of two or more kinds.

The polyester can be prepared by, for instance, polycondensation of an alcoholic component with a carboxylic acid component at a temperature of 180° to 250° C. in an inert gas atmosphere in the presence of an esterification catalyst as desired.

It is preferable that the polyester has an acid value of from 1 to 30 mg KOH/g, more preferably from 5 to 20 mg KOH/g, a hydroxyl value of from 5 to 40 mg KOH/g, a softening point of 100° to 160° C. and a glass transition point of 50° to 70° C.

As the colorants, all of the dyes and pigments which are used as colorants for toners can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These can be used alone or in admixture of two or more kinds. In the present invention, the toner may be any of black toners, color toners and full-color toners. The content of the colorant is preferably from 1 to 40 parts by weight, more preferably from 3 to 10 parts by weight, based on 100 parts by weight of the resin binder.

The toner in the present invention may contain a magnetic material such as powders of an alloy such as magnetite, hematite or ferrite; and powders of a ferromagnetic metal such as iron, cobalt and nickel, in an amount of from 0.5 to 10 parts by weight based on 100 parts by weight of the resin binder, in order to prevent toner scattering.

Further, the toner may appropriately contain an additive such as a charge control agent, a releasing agent, an electric conductivity modifier, an extender, a reinforcing filler such as a fibrous substance, an antioxidant, an anti-aging agent, a fluidity improver, and a cleanability improver.

The toner in the present invention can be prepared by a surface treatment step comprising mixing an untreated toner with a hydrophobic silica used as an external additive using a HENSCHEL MIXER or the like. The untreated toner is preferably a pulverized toner, and is obtained by, for instance, homogeneously mixing a resin binder, a colorant and the like in a mixer such as a HENSCHEL MIXER or a ball-mill, thereafter melt-kneading with a closed kneader, a single-screw or twin-screw extruder, or the like, cooling, roughly pulverizing the resulting product using a hammer-mill, and further finely pulverizing with a fine pulverizer utilizing a jet stream or a mechanical pulverizer, and classifying the pulverized product to a given particle size with a classifier utilizing rotary stream or a classifier utilizing Coanda effect.

The toner in the present invention has a volume-average particle size of preferably from 6 to 12 $\mu$m, more preferably from 7 to 9 $\mu$m.

In addition, in order to prevent the lowering of the fluidity of the toner by free silica, and to prevent the embedment of the silica, the content of toner particles having a particle size of 5 $\mu$m or less which cause an increase in the surface area is preferably from 10 to 50%, more preferably from 15 to 45%, on a number basis of the toner particles. In addition, the content of the toner particles, as calculated on a volume basis, is preferably from 0.1 to 15% by volume, more preferably from 0.5 to 9% by volume.

In the two-component developer of the present invention obtained by mixing a toner and a carrier, the weight ratio of the toner to the carrier (toner/carrier) is preferably from 0.5/100 to 8/100, more preferably from 1/100 to 6/100.

The two-component developer of the present invention is highly effective for the prevention of the carrier sticking on photoconductor, so that the embedment of silica can be prevented without causing the carrier sticking on photoconductor even when the two-component developer is used for an electrophotographic apparatus such as a copy machine or printer, comprising a photoconductor having a peripheral speed of preferably 400 mm/sec or more, more preferably from 400 to 2000 mm/sec.

EXAMPLES

[Acid Value and Hydroxyl Value]

The acid value and the hydroxyl value are measured by a method according to JIS K 0070.

[Softening Point]

The softening point refers to a temperature at which a half of the resin flows out, when measured by using a flow tester of the "koka" type "CFT-500D" (commercially available from Shimadzu Corporation) (sample: 1 g, rate of raising temperature: 6° C./min, load: 1.96 MPa, and nozzle: ϕ1 mm×1 mm).

[Glass Transition Point]

The glass transition point is determined using a differential scanning calorimeter "DSC 210" (commercially available from Seiko Instruments, Inc.) with raising the temperature at a rate of 10° C./min.

[Particle Size Distribution and Average Particle Size of Toner]

Measuring Apparatus: COULTER MULTISIZER II (commercially available from Beckman Coulter)

Aperture Diameter: 100 μm

Analyzing Software: COULTER MULTISIZER ACCUCOMP Ver. 1.19 (commercially available from Beckman Coulter)

Electrolyte: Isotone II (commercially available from Beckman Coulter)

Dispersion: 5% electrolyte of EMULGEN 109P (commercially available from Kao Corporation, polyoxyethylene lauryl ether, HLB: 13.6)

Dispersing Conditions: Ten milligrams of a test sample is added to 5 ml of a dispersion, and the resulting mixture is dispersed in an ultrasonic disperser for 1 minute. Thereafter, 25 ml of an electrolyte is added to the dispersion, and the resulting mixture is dispersed in an ultrasonic dispersing apparatus for another 1 minute.

Measurement Conditions: One-hundred milliliters of an electrolyte and a dispersion are added to a beaker, and the particle sizes of the particles are determined for 20 seconds under the conditions for concentration satisfying that the determination for 30000 particles are completed in 20 seconds, to obtain its particle size distribution.

[Surface Resistivity and Volume Resistivity of Carrier]

Using a device, of which cross-sectional view is shown in FIG. 1, comprising a cell 1 (thickness: 10 mm), an electrode A 2 (diameter: 80 mm), an electrode B 3 and an electrode C 4 (weight: 805 g, diameter: 120 mm), the cell 1 is filled with 500 g of a carrier so that the carrier has a thickness of 10 mm when evenly leveled, and the determination is carried out. The environmental conditions for determination are a temperature of 23° C. and humidity of 45%.

(1) Surface Resistivity

The surface resistivity is obtained using an electrode coefficient of 53.41 from the value of the electric current determined by using an electrode A 2 as a main electrode, an electrode B 3 as an electrode couple and an electrode C 4 as a guard electrode, connecting them to an electrometer "R 8340 A" (commercially available from Advantest Corporation), and applying a voltage of 100 V for 60 seconds.

(2) Volume Resistivity

The volume resistivity is determined in the same manner as in the surface resistivity using an electrode A 2 as a main electrode, an electrode B 3 as a guard electrode and an electrode C 4 as an electrode couple. Here, the electrode coefficient is 0.503.

Resin Preparation Example

The raw materials as shown in Table 1 were reacted in the presence of a catalytic amount of dibutyltin oxide under nitrogen gas stream, with stirring the ingredients at 200° C. for a resin A or at 230° C. for resins B and C. The reaction was allowed to proceed using the softening point as determined by the ring and ball method as an end point, to give the resins A to C. The softening point (Tm) and the glass transition point (Tg) of each of the resins are shown in Table 1.

TABLE 1

| | Resin A | Resin B | Resin C |
|---|---|---|---|
| BPA-PO [1)] | 100 | 70 | 70 |
| BPA-EO [2)] | | 30 | 30 |
| Fumaric Acid | 100 | | |
| Succinic Acid | | 30 | 10 |
| Dimethyl Terephthalate | | 45 | 70 |
| Trimellitic Anhydride | | 25 | 20 |
| Tm (° C.) | 100 | 142 | 118 |
| Tg (° C.) | 60 | 65 | 73 |

Note)
The used amount is expressed in molar ratio.
[1)] Polyoxypropylene(2.2)-2,2-bis(4-hydroxyphenyl)propane
[2)] Polyoxyethylene(2.2)-2,2-bis(4-hydroxyphenyl)propane Preparation Example 1 of Toner Seventy parts by weight of the resin A, 30 parts by weight of the resin B, 6 parts by weight of a colorant "MOGUL L" (commercially available from Cabot Corporation), 1 part by weight of a charge control agent "BONTRON S-34" (commercially available from Orient Chemical Co., Ltd.), 1 part by weight of a releasing agent "Viscol 550P" (commercially available from SANYO CHEMICAL INDUSTRIES, LTD.) and 1 part by weight of a magnetite "EPT 1002" (commercially available from Toda Kogyo Corp.) were melt-kneaded at 100° C. using an extruder. The resulting product was finely pulverized with a jet mill and classified by air classification, to give an untreated toner having a particle size distribution as shown in Table 2.

To 100 parts by weight of the resulting untreated toner, a hydrophobic silica as shown in Table 2 was mixed and adhered with a HENSCHEL MIXER, to give each of Toners 1 to 6 and Comparative Toners 1 to 4.

Preparation Example 2 of Toner

The same procedures were carried out as in Preparation Example 1 of Toner except that the amount of the resin A used was changed to 50 parts by weight and the resin C was used in an amount of 50 parts by weight, to give an untreated toner having a particle size distribution as shown in Table 2. Further, a hydrophobic silica as shown in Table 2 was mixed and adhered to the untreated toner, to give Toner 7.

TABLE 2

| | Volume-Average Particle Size (μm) | Toner Particles of 5 μm or less (% on Number Basis) | Toner Particles of 5 μm or less (% on Volume Basis) | Hydrophobic Silica* |
|---|---|---|---|---|
| Toner 1 | 7.5 | 41.3 | 8.5 | NAX50/1 R972/0.9 |
| Toner 2 | 7.4 | 33.9 | 8.5 | NAX50/1.8 |
| Toner 3 | 7.6 | 32.0 | 2.9 | RY50/1 R972/0.9 |
| Toner 4 | 8.6 | 21.7 | 2.5 | NAX50/1 R972/0.9 |
| Toner 5 | 9.7 | 16.6 | 1.3 | NAX50/1.8 |
| Toner 6 | 11.6 | 13.9 | 0.6 | RY50/1.8 |
| Toner 7 | 8.5 | 18.2 | 2.1 | NAX50/1.8 |
| Comp. Toner 1 | 6.9 | 24.3 | 7.0 | R972/0.9 |
| Comp. Toner 2 | 7.1 | 18.3 | 4.4 | TS530/0.6 |
| Comp. Toner 3 | 7.1 | 18.3 | 4.4 | R972/3 |

TABLE 2-continued

| | Volume-Average Particle Size (μm) | Toner Particles of 5 μm or less (% on Number Basis) | Toner Particles of 5 μm or less (% on Volume Basis) | Hydrophobic Silica* |
|---|---|---|---|---|
| Comp. Toner 4 | 7.1 | 18.3 | 4.4 | TS530/3 |

*The used amount is expressed in parts by weight.
NAX50 (commercially available from Nippon Aerosil), average particle size: 40 nm
RY50 (commercially available from Nippon Aerosil), average particle size: 40 nm
TS530 (commercially available from Cabot Corporation), average particle size: 12 nm
R972 (commercially available from Nippon Aerosil), average particle size: 16 nm

Preparation Example of Carrier

A mixture comprising 40% by mol of manganese oxide (MnO), 15% by mol of magnesium oxide (MgO), 44.5% by mol of iron (III) oxide ($Fe_2O_3$) and 0.5% by mol of strontium carbonate ($SrCO_3$) was pulverized and mixed with a wet-type ball-mill, dried, and thereafter calcined. The resulting product was pulverized with a wet-type ball-mill, to a particle size of 3 μm or less. A dispersant and a binder were added to this slurry, and the resulting mixture was granulated and dried with a spray-drier. The resulting product was backed in an electric oven, and during this time the sintering temperature was changed to adjust the saturation magnetization and the grain diameter. Thereafter, the resulting product was disintegrated, and further classified, to give a core material of a ferrite particle. A silicone resin "SR2411" (commercially available from Dow Corning Toray Silicone) was dissolved in a toluene solvent, and coated onto the above core material using a fluidized bed. The resulting product was further sintered, and during this time the resistance of the carrier was adjusted by changing the amount of "SR2411" and the sintering temperature, to give carriers 1 and 2 as shown in Table 3.

Similarly, a magnetite, a Cu—Zn-based ferrite, an Mg-based ferrite or an Mn-based ferrite was used as a core material, and the amount of coated resin and the sintering temperature during the coating were adjusted, to give Carriers 3 to 5 and Comparative Carriers 1 to 5 as shown in Table 3.

TABLE 3

| | Core Material | Weight-Average Particle Size (μm) | Particles of 22 μm or less (% by weight) | Saturation Magnetization ($Am^2/kg$) | Rs (Ω) | Rv (Ωm) | Rs/Rv ($m^{-1}$) |
|---|---|---|---|---|---|---|---|
| Carrier 1 | Mn-Mg-Sr-Based Ferrite | 62 | 0 | 61 | $1.90 \times 10^{15}$ | $6.30 \times 10^{11}$ | $3.02 \times 10^{3}$ |
| Carrier 2 | Mn-Mg-Sr-Based Ferrite | 63 | 0 | 68 | $9.96 \times 10^{11}$ | $2.30 \times 10^{9}$ | $4.17 \times 10^{2}$ |
| Carrier 3 | Magnetite | 68 | 0 | 82 | $4.80 \times 10^{14}$ | $3.50 \times 10^{12}$ | $1.37 \times 10^{2}$ |
| Carrier 4 | Cu-Zn-Based Ferrite | 60 | 0.5 | 64 | $2.00 \times 10^{15}$ | $9.70 \times 10^{11}$ | $2.06 \times 10^{3}$ |
| Carrier 5 | Mg-Based Ferrite | 66 | 1.0 | 58 | $6.5 \times 10^{14}$ | $3.1 \times 10^{13}$ | $2.1 \times 10^{2}$ |
| Comp. Carrier 1 | Magnetite | 63 | 0 | 82 | $2.6 \times 10^{18}$ | $4.0 \times 10^{12}$ | $6.5 \times 10^{5}$ |
| Comp. Carrier 2 | Mn-Based Ferrite | 60 | 0 | 95 | $1.50 \times 10^{15}$ | $1.10 \times 10^{14}$ | $1.36 \times 10^{1}$ |
| Comp. Carrier 3 | Mg-Based Ferrite | 54 | 3.4 | 58 | $4.40 \times 10^{17}$ | $5.00 \times 10^{16}$ | $8.8 \times 10^{0}$ |
| Comp. Carrier 4 | Mn-Mg-Sr-Based Ferrite | 62 | 0 | 65 | $3.40 \times 10^{14}$ | $3.12 \times 10^{9}$ | $1.09 \times 10^{5}$ |
| Comp. Carrier 5 | Magnetite | 62 | 0 | 82 | $3.40 \times 10^{9}$ | $3.12 \times 10^{8}$ | $1.09 \times 10^{1}$ |

Examples 1 to 13 and Comparative Examples 1 to 10

Five parts by weight of a toner and 95 parts by weight of a carrier, as shown in Tables 4 and 5, were mixed with a turbuler shaker mixer, to give each two-component developer.

The resulting two-component developer was loaded in a high-speed machine of a modified apparatus of "SD2075" (commercially available from Sharp Corporation) in which the peripheral speed of the organic photoconductor was adjusted to 600 mm/sec. Printing was carried out at a printing ratio of 10% up to 50000 sheets and at a printing ratio of 2% for the 50000th sheet to the 100000th sheet. During the continuous printing, the image densities after printing 1000 sheets (initial printing) and after printing 100000 sheets, and the carrier sticking on photoconductor, the background fogging and the toner scattering after 100000 sheets were evaluated by the following methods. The results are shown in Tables 4 and 5.

[Image Density]

An optical reflective density is measured with a reflective densitometer "RD-915" (commercially available from Macbeth Process Measurements Co.). The image density is evaluated by the following evaluation criteria.

| (Evaluation Criteria) | |
|---|---|
| ◎: | 1.4 or more |
| ○: | 1.3 or more and less than 1.4 |
| Δ: | 1.2 or more and less than 1.3 |
| X: | less than 1.2 |

[Carrier Sticking on Photoconductor]

The number of white spots caused by the carrier sticking on photoconductor is counted when 10 sheets of solid images (10 cm×12 cm) are printed. The carrier sticking on a photoconductor is evaluated by the following evaluation criteria.

| (Evaluation Criteria) | |
|---|---|
| ◎: | 0 spots per sheet |
| ○: | 1 spot per sheet |
| Δ: | 2 to 5 spots per sheet |
| X: | 6 or more spots per sheet |

[Background Fogging]

The degree of whiteness in a non-image-bearing portion is measured with a spectrophotometer "SZ-Σ90" (commercially available from Nihon Denshoku Kogyo K. K.), and the background fogging is evaluated by the following evaluation criteria.

| (Evaluation Criteria) | |
|---|---|
| ○: | less than 0.5 |
| Δ: | 0.5 or more and less than 1.0 |
| X: | 1.0 or more |

[Toner Scattering]

The amount of toner scattering within the machine is determined for 6 seconds with a digital dust indicator "Model P-5H2" (commercially available from SHIBATA SCIENTIFIC TECHNOLOGY LTD.). The toner scattering is evaluated by the following criteria.

| (Evaluation Criteria) | |
|---|---|
| ◎: | 0 or more and less than 20 |
| ○: | 20 or more and less than 40 |
| Δ: | 40 or more and less than 60 |
| X: | 60 or more |

TABLE 4

| | | | Image Density | | After 100000 Sheets | | |
|---|---|---|---|---|---|---|---|
| | | | | | Carrier | | |
| | Toner | Carrier | After 1000 Sheets | After 100000 Sheets | Sticking on Photoconductor | Background Fogging | Toner Scattering |
| Example 1 | Toner 1 | Carrier 1 | ◎ | ◎ | ◎ | ○ | ○ |
| Example 2 | Toner 1 | Carrier 2 | ◎ | ○ | ○ | ○ | ○ |
| Example 3 | Toner 1 | Carrier 3 | ○ | ○ | ◎ | ○ | ○ |
| Example 4 | Toner 1 | Carrier 4 | ○ | ○ | ○ | ○ | ◎ |
| Example 5 | Toner 1 | Carrier 5 | ○ | ○ | ○ | ○ | ○ |
| Example 6 | Toner 2 | Carrier 1 | ○ | ○ | ○ | ○ | ○ |
| Example 7 | Toner 3 | Carrier 1 | ○ | ○ | ○ | ○ | Δ |
| Example 8 | Toner 4 | Carrier 1 | ◎ | ◎ | ○ | ○ | ○ |
| Example 9 | Toner 4 | Carrier 2 | ◎ | ○ | ○ | ○ | ○ |
| Example 10 | Toner 4 | Carrier 4 | ○ | ○ | ○ | ○ | ○ |
| Example 11 | Toner 5 | Carrier 1 | ◎ | Δ | ○ | ○ | ◎ |
| Example 12 | Toner 6 | Carrier 1 | ◎ | Δ | ○ | ○ | ◎ |
| Example 13 | Toner 7 | Carrier 1 | Δ | ◎ | ○ | ○ | ○ |

TABLE 5

| | | | Image Density | | After 100000 Sheets | | |
|---|---|---|---|---|---|---|---|
| | | | | | Carrier | | |
| | Toner | Carrier | After 1000 Sheets | After 100000 Sheets | Sticking on Photoconductor | Background Fogging | Toner Scattering |
| Comp. Example 1 | Toner 1 | Comp. Carrier 1 | Δ | X | ○ | Δ | ○ |
| Comp. Example 2 | Toner 1 | Comp. Carrier 2 | Δ | X | Δ | ○ | Δ |
| Comp. Example 3 | Toner 1 | Comp. Carrier 3 | X | X | ○ | ○ | ○ |
| Comp. Example 4 | Toner 1 | Comp. Carrier 4 | ○ | ○ | X | X | Δ |

TABLE 5-continued

| | | | Image Density | | After 100000 Sheets | | |
|---|---|---|---|---|---|---|---|
| | | | | | Carrier | | |
| | Toner | Carrier | After 1000 Sheets | After 100000 Sheets | Sticking on Photoconductor | Background Fogging | Toner Scattering |
| Comp. Example 5 | Toner 1 | Comp. Carrier 5 | ○ | ○ | X | Δ | Δ |
| Comp. Example 6 | Comp. Toner 1 | Carrier 1 | ○ | X | ○ | ○ | Δ |
| Comp. Example 7 | Comp. Toner 1 | Carrier 4 | ○ | X | ○ | ○ | ○ |
| Comp. Example 8 | Comp. Toner 2 | Carrier 4 | ◎ | X | ○ | Δ | ○ |
| Comp. Example 9 | Comp. Toner 3 | Carrier 4 | ○ | X | ○ | Δ | ○ |
| Comp. Example 10 | Comp. Toner 4 | Carrier 4 | Δ | X | ○ | Δ | ○ |

It is seen from the above results that high-quality images can be continuously obtained without causing the carrier sticking on photoconductor in all of Examples 1 to 13. On the other hand, it is seen that the carrier sticking on photoconductor, the toner scattering, and a decrease in the image density are caused in Comparative Examples 1 to 5 in which the values of Rs/Rv of the carriers are not adjusted. Also, it is seen that the image density is drastically decreased in Comparative Examples 6 to 10 in which a toner comprising only a hydrophobic silica of a small particle size is used.

According to the present invention, there can be provided a two-component developer which can continuously give high-quality images, even in a high-speed machine, without causing the embedment of silica and the carrier sticking on photoconductor.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A two-component developer comprising:

a toner onto which a hydrophobic silica having an average particle size of 25 nm or more is externally added, and a carrier having a saturation magnetization of from 50 to 95 $Am^2/kg$, wherein the carrier has a ratio of surface resistivity to volume resistivity of from $1\times10^2$ to $1\times10^4$ $m^{-1}$ at an electric field strength of 100 V/cm.

2. The two-component developer according to claim 1, wherein the carrier has a surface resistivity of from $1\times10^{10}$ to $1\times10^{17}$ Ω.

3. The two-component developer according to claim 1, wherein the toner has a volume-average particle size of from 6 to 12 μm and the content of toner particles having a particle size of 5 μm or less is 10 to 50% on a number basis of the toner particles.

4. The two-component developer according to claim 1, for use in an electrophotographic device comprising a photoconductor having a peripheral speed of 400 mm/sec or more.

5. A method for development comprising applying the two-component developer of claim 1 to an electrophotographic device comprising a photoconductor having a peripheral speed of 400 mm/sec or more, and developing a latent image.

* * * * *